United States Patent [19]

Lingmann et al.

[11] 4,284,434

[45] Aug. 18, 1981

[54] PROCESS FOR SPRAY CLEANING OF METAL SURFACES

[75] Inventors: Herbert Lingmann, Hilden; Hermann Drosdziok, Düsseldorf; Rudolf Peifer, Düsseldorf-Mörsenbroich, all of Fed. Rep. of Germany

[73] Assignee: Henkel Kommanditgesellschaft auf Aktien, Dusseldorf-Holthausen, Fed. Rep. of Germany

[21] Appl. No.: 96,027

[22] Filed: Nov. 20, 1979

Related U.S. Application Data

[63] Continuation of Ser. No. 888,306, Mar. 20, 1978, abandoned.

[30] Foreign Application Priority Data

Mar. 24, 1977 [DE] Fed. Rep. of Germany ..... 2712900

[51] Int. Cl.[3] ..... C23G 1/14

[52] U.S. Cl. ..... 134/2; 134/40

[58] Field of Search ..... 134/3, 40, 41, 2; 252/117, 528, 546, 547, DIG. 1

[56] References Cited

U.S. PATENT DOCUMENTS

| | | | |
|---|---|---|---|
| 2,577,773 | 12/1951 | Lambert | 252/547 X |
| 3,595,800 | 7/1971 | Wieczorek | 252/117 |
| 3,663,445 | 5/1972 | Augustin et al. | 252/546 X |
| 3,850,834 | 11/1974 | Hellsten et al. | 252/117 |
| 3,881,948 | 5/1975 | Schoenholz et al. | 134/40 X |
| 3,976,588 | 8/1976 | McLaughlin | 252/117 |

FOREIGN PATENT DOCUMENTS

| | | |
|---|---|---|
| 710827 | 6/1968 | Belgium . |
| 1602731 | 1/1971 | France . |
| 991597 | 5/1965 | United Kingdom . |

*Primary Examiner*—Marc L. Caroff

*Attorney, Agent, or Firm*—Hammond & Littell, Weissenberger and Muserlian

[57] ABSTRACT

A method of cleaning metal surfaces comprising spraying a metal surface with an aqueous solution containing (a) at least one soluble salt of a carboxylic acid having 6 to 12 carbon atoms selected from the group consisting of aromatic carboxylic acids, aliphatic carboxylic acids and mixtures thereof, (b) at least one nonionic surface-active compound, (c) at least one quaternary ammonium surface-active compound, where the concentration of the active-substances (a), (b) and (c) in the aqueous solution is from 0.1% to 4% by weight and the weight ratio of (b) to (c) is from 20:1 to 1:1 and the weight ratio of (a) to (b)+(c) is from 20:1 to 1:20, where the pH of the aqueous solution is from 7.5 to 11.

8 Claims, No Drawings

PROCESS FOR SPRAY CLEANING OF METAL SURFACES

This application is a continuation of our copending patent application Ser. No. 888,306, filed Mar. 20, 1978, and now abandoned.

BACKGROUND OF THE INVENTION

The cleaning of metal parts in industrial finishing is frequently effected in spray-washing plants in which an aqueous washing fluid is circulated and sprayed by means of nozzles onto the metal parts to be cleaned.

Washing fluids are frequently used which contain organic anti-corrosive components, particularly alkanol amines and fatty acids and/or aromatic carboxylic acids. Furthermore, the solutions may contain small quantities of inorganic components such as sodium nitrite or phosphates as inhibitors for example, for non-ferrous metals, dissolving intermediaries and preservatives. The pH value of the solutions used generally lies in the range of from 7.5 to 11.

In addition to the components already mentioned, these cleaning solutions may contain surface-active compounds or tensides for the purpose of obtaining a degreasing and cleaning action. Since the cleaning solutions must not foam when used in spray-washing plants, nonionic tensides or combinations of non-ionic tensides are customarily used.

The reason for the use of nonionic tensides is their low solubility at higher temperatures (inverse solubility) and thus the precipitation of a phase, richer in wetting agent and finely distributed, at the so-called turbidity point. Nonionic tensides exhibit a distinctly lower tendency to foam above the turbidity point. Nonionic surfactants customarily used are products of addition of ethylene oxide and/or propylene oxide to compounds having a labile hydrogen atom such as alkylphenols, fatty alcohols, fatty amines, fatty acids, fatty acid amides or similar compounds, as well as block polymers of polyethylene oxide and polypropylene oxide.

When used for a long period of time, these known cleaning solutions tend to precipitate the wetting agents, present at the turbidity point in the form of a fine dispersion in large drops and layers on the metal surface, whereby the tensides on the metal surface are passed to the rinsing step where they are flushed out and are no longer available for the cleaning method and for regulating the foam. The risk of the precipitation of wetting agent is particularly great in washing plants having a high pump performance and relatively small alkaline solution containers. The precipitation of coarsely distributed tensides on the metal surfaces causes, on the one hand, the disadvantage of a reduction in the efficacy of the washing action which is substantially based on the tenside content of the cleaning solution and, on the other hand, the disadvantage that the components remaining in the solution, such as the organic anti-corrosive components, can lead to the foaming-over of the washing plants after precipitation of those nonionic tensides which have a foam-inhibiting effect when finely distributed.

OBJECTS OF THE INVENTION

An object of the present invention is the development of a method of cleaning metals by a spray method at a pressure of 10 atmospheres gauge or higher using slightly alkaline aqueous solutions containing anti-corrosive components and a critical combination of nonionic and cationic surface-active compounds and, optionally, builders and inhibitors.

Another object of the present invention is the development of a method of cleaning metal surfaces comprising spraying a metal surface with an aqueous solution consisting essentially of water and (a) at least one water-soluble salt selected from the group consisting of alkali metal salts, ammonium salts and salts of alkanolamines having 2 to 9 carbon atoms, of monocarboxylic acids having 6 to 12 carbon atoms selected from the group consisting of benzoic acid, alkylbenzoic acids, phenylalkanoic acids, phenylalkenoic acids, alkanoic acids and mixtures thereof, (b) at least one nonionic surface-active compound having an HLB value of between 14 and 20, and (c) at least one quaternary ammonium surface-active compound, wherein the concentration of the active substances (a), (b) and (c) in the aqueous solution is from 0.1% to 4% by weight, the weight ratio of (b) to (c) is from 20:1 to 1:1, the weight ratio of (a) to (b)+(c) is from 20:1 to 1:20, and the pH of the aqueous solution is from 7.5 to 11.

A further object of the invention is the development of the above aqueous solution.

These and other objects of the invention will become more apparent as the description thereof proceeds.

DESCRIPTION OF THE INVENTION

We have now found that the disadvantages of the previous practices can be avoided and the above objects achieved by the practice of the method in accordance with the present invention. Precipitation of the nonionic tensides and the foaming of the spray plants may be prevented during the working time.

The method, in accordance with the present invention, for the cleaning of metals comprises spraying a metal surface with an aqueous solution comprising, (a) at least one soluble salt, preferably at least one alkanolamine salt, of an aromatic carboxylic acid and/or branched and/or straight chain aliphatic carboxylic acid having 6 to 12 carbon atoms, (b) at least one nonionic surface-active compound, and (c) at least one quaternary ammonium surface-active compound, the concentration of active substance a, b and c in the aqueous solution being from 0.1 to 4% by weight, the weight ratio of the nonionic tensides to the quaternary ammonium compounds being 20:1 to 1:1, the weight ratio of carboxylic acid salt to the total of nonionic surfactants and quaternary ammonium compounds being 20:1 to 1:20, and the cleaning being effected to a pH value from 7.5 to 11, preferably 8.5 to 10.

More particularly, the invention relates to a method of cleaning metal surfaces comprising spraying a metal surface with an aqueous solution consisting essentially of water and (a) at least one water-soluble salt selected from the group consisting of alkali metal salts, ammonium salts and salts of alkanolamines having 2 to 9 carbon atoms, of monocarboxylic acids having 6 to 12 carbon atoms selected from the group consisting of benzoic acid, alkylbenzoic acids, phenylalkanoic acids, phenylalkenoic acids, alkanoic acids and mixture thereof, (b) at least one nonionic surface-active compound having an HLB value of between 14 and 20, and (c) at least one quaternary ammonium surface-active compound, wherein the concentration of the active substances (a), (b) and (c) in the aqueous solution is from 0.1% to 4% by weight, the weight ratio of (b) to (c) is from 20:1 to 1:1, the weight ratio of (a) to (b)+(c) is from 20:1 to 1:20, and the pH of the aqueous solution is from 7.5 to 11.

In addition the aqueous solution employed is part of the present invention, that is an aqueous solution consisting essentially of water and (a) at least one water-soluble salt selected from the group consisting of alkali metal salts, ammonium salts and salts of alkanolamines having 2 to 9 carbon atoms, of monocarboxylic acids having 6 to 12 carbon atoms selected from the group consisting of benzoic acid, alkylbenzoic acids, phenylalkanoic acids, phenylalkenoic acids, alkanoic acids and mixtures thereof, (b) at least one nonionic surface-active compound having an HLB value of between 14 and 20, and (c) at least one quaternary ammonium surface-active compound, wherein the concentration of the active substances (a), (b) and (c) in the aqueous solution is from 0.1% to 4% by weight, the weight ratio of (b) to (c) is from 20:1 to 1:1, the weight ratio of (a) to (b)+(c) is from 20:1 to 1:20, and the pH of the aqueous solution is from 7.5 to 11.

In the method in accordance with the present invention, the alkali metal, ammonium and, in particular, the alkanolamine salts, of carboxylic acids having 6 to 12 carbon atoms, such as benzoic acid, alkylbenzoic acids such as tertiary butylbenzoic acid, phenylalkanoic acids such as phenylacetic acid, phenylalkenoic acids such as cinnamic acid, alkanoic acids such as caprylic acid, capric acid, isooctanoic acid, isononanoic acid and isodecanoic acid, are used as soluble salts of aromatic carboxylic acids and/or branched and/or straight chain alphatic carboxylic acids. The soluble salts of carboxylic acids may be used individually or mixed. The preferred alkanolamine salts are those of alkanolamines having 2 to 9 carbon atoms such as ethanolamine, diethanolamine, triethanolamine, propanolamines, dipropanolamines, tripropanolamine, isopropanolamine, di-isopropanolamine and, tri-isopropanolamine.

In addition to these soluble salts of carboxylic acids, the solutions used in the method in accordance with the present invention contain at least one nonionic surface-active compound or tensides such as compounds of addition of alkylene oxides particularly ethylene oxide and mixtures of ethylene oxide and propylene oxide to compounds having an aliphatic carbon chain 8 to 18 carbon atoms and a labile hydrogen atom such as higher fatty alcohols, higher fatty amines, higher fatty acids, higher fatty acid amines and alkylphenols, and/or block polymers from ethylene oxide and propylene oxide.

Suitable nonionic surface-active compounds or tensides are the addition products of 4 to 40, preferably 4 to 20 mols of ethylene oxide to 1 mol of a higher fatty alcohol, $C_{8-18}$ alkylphenol, higher fatty acid, higher fatty amine, or higher fatty acid amide. Particularly important are the addition products of 5 to 15 mols of ethylene oxide to coconut fatty alcohols or tallow fatty alcohols, to oleyl alcohol or to secondary alkanols with 8 to 18, preferably 12 to 18 carbon atoms, as well as monoalkylphenols or dialkylphenols with 6 to 14 carbon atoms in the alkyls. In addition to these water-soluble nonionics, polyglycol ethers with 1 to 4 ethylene glycol ether radicals in the molecule, which are insoluble or not completely water-soluble, are also of interest, particularly if they are used together with water-soluble nonionic tensides.

Furthermore, the water-soluble addition products of ethylene oxide to polyoxypropylene glycol containing 10 to 100 propylene glycol ethers groups (Pluronics ®), to alkylenediamine polyoxypropylene glycol (Tetronics ®), and to alkylpolyoxypropylene glycols with 1 to 10 carbon atoms in the alkyl chain, can also be used where the polyoxypropylene glycol chain acts as a hydrophobic radical. Preferably the nonionic tensides should have an HLB value of from 14 to 20.

In addition to the salts of carboxylic acids and nonionic tensides, the solutions used in accordance with the invention contain, as a third essential constituent, at least one quaternary ammonium surface-active compound. By way of example, imidazolium, pyridinium or piperidinium salts and, in particular, quaternary ammonium compounds of the $C_{8-22}$ alkyldimethylbenzyl ammonium salts type (commercial name "Zephirol") and $C_{8-22}$ alkyltrimethylammonium salts may be used as quaternary ammonium salts. The salts are customary those with acids such as the strong mineral acids and lower alkyl monoesters with sulfuric acid.

The three components given above are to be used in a specific weight ratio, the weight ratio of nonionic tensides to the quaternary ammonium compounds being 20:1 to 1:1, and the weight ratio of the carboxylic acid salts to the total of nonionic tensides and quaternary ammonium surface-active compounds being 20:1 to 1:20. The ratio of the three components relative to one another is determined by whether the method is used primarily for cleaning the metal surfaces to be treated or for protecting them against corrosion. A combination having a relatively high content of tensides is used when the primary object is that of cleaning the metal surfaces, while larger quantities of the soluble salts of the said carboxylic acids are used when the primary object is that of protection against corrosion.

The solutions for performing the method in accordance with the present invention, may, if required, also contain additives of alkanolamines to maintain the pH, builders such as alkali metal phosphates, particularly condensed phosphates and borates, inhibitors, particularly for non-ferrous metals such as alkali metal nitrites. Furthermore, biocides such as hexahydrotriazine derivatives and/or phenols and/or chlorophenols may be added to the solutions for the purpose of preventing contamination by bacteria and/or fungi.

The content of active substance of the components a, b and c in the solutions used in the method is from 0.1% to 4% by weight, preferably from 0.3% to 1.2% by weight.

The content of alkanolamines in the aqueous solutions in excess of that required to form the salt is sufficient to maintain the desired pH. The amount of builders employed in the aqueous solutions is from 0 to 0.5% by weight; the amount of inhibitors is from 0 to 0.4% by weight; the amount of biocides is from 0 to 0.2% by weight.

Liquid concentrates having active substance contents of from 20% to 80% are generally used to produce these solutions, partially with the joint use of dissolving intermediaries.

The turbidity point of the solutions used in the method is usually adjusted such that it lies below the working temperature. In general, working temperatures between 20° and 80° C. are preferred. Preferably the aqueous solution is maintained at a preselected temperature between 20° C. and 80° C. and the components (a), (b), and (c) are so selected that the turbidity point of said aqueous solution lies from 5° C. to 25° C. below said preselected temperature.

The present invention will now be further illustrated by way of the following examples:

EXAMPLE 1

A solution of the following composition 0.5% triethanolamine
0.3% caprylic acid
0.1% ethylene oxide propylene oxide block polymer (Pluronics® L62)

and having a pH value of 9.1 at 50° to 60° C., was used in an experimental spray plant having a bath volume of 20 liters and a spray pressure of 10 atmospheres gauge pressure. The tenside was deposited virtually quantitatively on the surface after a few hours, and the solution, originally turbid at the operating temperature of 50° to 60° C., was completely clear. The solution commenced to foam when the tenside was deposited on the surface, so that the test had to be terminated.

In a second test, 0.02% of lauryl-dimethylbenzylammonium-chloride were added to a cleaning solution of the composition given above. This cleaning solution could be sprayed over the entire test period of 5 days without precipitation of tensides and without the development of foam. The solution had a satisfactory cleaning action which, like the protection against corrosion, did not change over the entire test period.

EXAMPLE 2

Iron and steel parts were cleaned with a solution of the following composition in a continuous spray plant having a bath volume of 3 $m^3$ and a spray pressure of 12 atmospheres gauge pressure:

0.2% Diethanolamine
0.02% tert.-butylbenzoic acid
0.02% Isononanoic acid
0.2% Product of addition of 9 mols of ethylene oxide+10 mols of propylene oxide to nonylphenol
0.05% Oleyldimethylbenzylammonium chloride
0.01% Mercaptobenzthiazole The working temperature was 70° C. and the pH value of the solution was 9.3. Precipitation of tensides did not occur during the entire test period of 14 days, and the cleaning solution could be sprayed in a foam-free manner up to the end of the test period. Normally soiled parts were cleaned in a satisfactory manner and the protection against corrosion was adequate. In the case of parts soiled with lapping pastes, an additive of sodium tripolyphosphate in a concentration of 0.1% resulted in the satisfactory cleaning of these parts which are difficult to treat.

EXAMPLE 3

In the experimental spray plant described in Example 1, work was carried out with the cleaning solutions given hereinafter at differing working temperatures (stated in each case) for a period of 5 days without development of foam and without any precipitation of tensides. Test parts could be cleaned and protected against corrosion in a satisfactory manner.

| | | |
|---|---|---|
| (A) | 0.2% | Isononanoic acid |
| | 0.3% | Triethanolamine |
| | 0.2% | Sodium nitrite |

-continued

| | | |
|---|---|---|
| | 0.04% | Ethylene oxide propylene oxide block polymer (Pluronics® L64) |
| | 0.005% | Lauryldimethylbenzylammonium chloride |
| | 0.1% | Hexahydrotriazine derivative |
| | pH value: | 9.0 Working temperature: 40° C. |
| (B) | 0.3% | Sodium caprylate |
| | 0.1% | Triethanolamine |
| | 0.05% | Products of addition of 6 mols of propylene oxide to a higher fatty alcohol |
| | 0.03% | Oleyldimethylbenzylammonium chloride |
| | 0.01% | Mercaptobenzthiazole |
| | 0.1% | Borax |
| | 0.15% | Sodium tripolyphosphate |
| | pH value: | 9.5 Working temperature: 20° C. |
| (C) | 0.15% | Cinnamic acid |
| | 0.15% | Benzoic acid |
| | 0.4% | Diethanolamine |
| | 0.01% | Ethyleneoxide propylene oxide block polymer (Pluronics® L62) |
| | 0.01% | Lauryldimethylbenzylammonium chloride |
| | 0.1% | Hexahydrotriazine derivative |
| | pH value: | 9.2 Working temperature: 60° C. |
| (D) | 0.015% | Isononanoic acid |
| | 0.01% | Capric acid |
| | 0.2% | Triethanolamine |
| | 0.2% | Monoethanolamine |
| | 0.15% | Ethylene oxide propylene oxide block polymer (Pluronics® L64) |
| | 0.075% | Product of addition of 8 mols of ethylene oxide to nonylphenol |
| | 0.075% | Product of addition of 10 mols of ethylene oxide to a higher fatty amine |
| | 0.06% | Cetyltrimethylammonium chloride |
| | 0.2% | Sodium nitrite |
| | pH value: | 9.5 Working temperature: 50° C. |

The preceding specific embodiments are illustrative of the practice of the invention. It is to be understood however, that other expedients known to those skilled in the art or disclosed herein, may be employed without departing from the spirit of the invention or the scope of the amended claims.

We claim:

1. A method of cleaning metal surfaces comprising spraying a metal surface at a pressure of 10 atmospheres gauge or higher with an aqueous solution consisting essentially of water containing a mixture of active substances of (a) at least one water-soluble alkanolamine salt of alkanolamines having 2 to 9 carbon atoms, of monocarboxylic acids selected from the group consisting of benzoic acid, tertiary butylbenzoic acid, phenylacetic acid, cinnamic acid, caprylic acid, capric acid, isooctanoic acid, isononanoic acid, isodecanoic acid and mixtures thereof, (b) at least one nonionic surface-active compound having an HLB value of between 14 and 20, and (c) at least one quaternary ammonium surface-active compound, wherein the concentration of the mixture of active substances (a), (b) and (c) in the aqueous solution is from 0.1% to 4% by weight, the weight ratio of (b) to (c) is from 20:1 to 1:1, the weight ratio of (a) to (b)+(c) is from 20:1 to 1:20, and sufficient alkanolamine having 2 to 9 carbon atoms is present whereby the pH of the aqueous solution is from 7.5 to 11, wherein the aqueous solution is maintained at a preselected temperature between 20° C. and 80° C. and the components (a), (b) and (c) are so selected that the turbidity point of said aqueous solution lies from 5° C. to 25° C. below said preselected temperature.

2. The method of claim 1 wherein said pH is between 8.5 and 10.

3. The method of claim 1 wherein said component (c) is at least one $C_{8-22}$-alkyldimethylbenzylammonium salt with an acid selected from the group consisting of strong inorganic acids and acid lower alkyl half esters of sulfuric acid.

4. The method of claim 1 wherein the concentration of active substances is from 0.3% to 1.2% by weight.

5. The method of claim 1 wherein said aqueous solution contains at least one further additive of the type: builders, inhibitors and biocides.

6. In the industrial process for cleaning of metal parts in a spray-washing plant comprising spraying said metal parts at a pressure of 10 atmospheres gauge or higher with a recirculated washing fluid in a spraying zone, rinsing said metal parts in a rinsing step and recovering said cleaned metal parts, the improvement comprising employing an aqueous solution consisting essentially of water, containing a mixture of active substances of:

(a) at least one water-soluble alkanolamine salt of alkanolamines having 2 to 9 carbon atoms, of monocarboxylic acids selected from the group consisting of benzoic acid, tertiary butylbenzoic acid, phenylacetic acid, cinnamic acid, caprylic acid, capric acid, isooctanoic acid, isononanoic acid, isodecanoic acid and mixtures thereof, (b) at least one nonionic surface-active compound having an HLB value of between 14 and 20, and (c) at least one quaternary ammonium surface-active compound, wherein the concentration of the mixture of active substances (a), (b) and (c) in the aqueous solution is from 0.1% to 4% by weight, the weight ratio of (b) to (c) is from 20:1 to 1:1, the weight ratio of (a) to (b)+(c) is from 20:1 to 1:20, and sufficient alkanolamine having 2 to 9 carbon atoms is present whereby the pH of the aqueous solution is from 7.5 to 11, wherein the aqueous solution is maintained at a preselected temperature between 20° C. and 80° C. and the components (a), (b) and (c) are so selected that the turbidity point of said aqueous solution lies from 5° C. to 25° C. below said preselected temperature, as said recirculated washing fluid, whereby no foaming or precipitation of tensides occurred over spray periods of at least five days.

7. The method of cleaning metal surfaces of claim 1 wherein said spray pressure is from 10 to 12 atmospheres gauge.

8. The industrial process for cleaning metal parts of claim 6 wherein said spray pressure is from 10 to 12 atmospheres gauge.

* * * * *